United States Patent [19]

Fechant et al.

[11] 4,237,355

[45] Dec. 2, 1980

[54] BLOWING ELEMENT

[75] Inventors: Louis Fechant, Le Vesinet; Jean-Pierre Guery, Poissy; Gabriel Martin, Houilles, all of France

[73] Assignee: La Telemecanique Electrique, Nanterre, France

[21] Appl. No.: 872,188

[22] Filed: Jan. 25, 1978

[30] Foreign Application Priority Data

Jan. 25, 1977 [FR] France ..... 77 02009

[51] Int. Cl.[2] ..... H01H 33/18

[52] U.S. Cl. ..... 200/147 R

[58] Field of Search ..... 200/147

[56] References Cited

U.S. PATENT DOCUMENTS

| | | | |
|---|---|---|---|
| 3,555,471 | 1/1971 | Mitskevich et al. | 200/147 R |
| 3,564,176 | 2/1971 | Fechant | 200/147 R |
| 3,593,227 | 7/1971 | Mitskevich et al. | 200/147 R |

*Primary Examiner*—Robert S. Macon

*Attorney, Agent, or Firm*—William A. Drucker

[57] ABSTRACT

An arc blowing element comprises two parallel arms and a stem disposed in the neighborhood of a support for a fixed contact, and a deflector coupled to an extremity of that arm which is remote from the contact and to which it is perpendicular, in order to extend up to the arc extinction chamber.

5 Claims, 5 Drawing Figures

BLOWING ELEMENT

BACKGROUND OF THE INVENTION

The invention relates to a blowing element for arcs passing between a movable contact and the button of a fixed contact placed on the external free arm of a support in the form of a 'U' having two parallel branches and a common stem and disposed in the neighbourhood of the same stem, said element taking the form of a 'U' analogous to that of the support and being connected electrically and mechanically to the support, and which has two lateral portions surrounding the contact button, these members being disposed in an extinction chamber provided with wings.

Such an element is used in the arc chambers of breaker devices.

THE PRIOR ART

There are already known apparatus conforming to the construction mentioned hereinabove, in which the blowing element in the form of a 'U' and the support of the button are in contact along a large surface. This disposition results in a partial short-circuit of the lines of current of the arc, which ends at the lateral portions. Furthermore, these apparatus have neither deflecting electrodes, nor members limiting the geometrical deformation of the support in the course of operation, such that there is reason to fear a deterioration of the arc chamber in the region of the casing containing the extinguisher wings and respectively irreversible deformations of the support for the contact.

OBJECT OF THE INVENTION

The invention accordingly proposed to provide a blowing element which gives the maximum of efficacity to the currents which pass through it, which is associated with an arc deflection member and which has a structure such that the deformations of the support of the button contact are limited.

There are likewise known devices which limit the deformations of the contact element by the interposition of packings of plastics material. These means do not give entire satisfaction by reason of their sensibility to high temperatures.

SUMMARY OF THE INVENTION

According to the invention, the result sought is obtained by reason of:

the first arm of the blowing element of which the surface is placed substantially at the level of the plane of the fixed contact button without touching the neighbouring support arm, has on the one hand a tongue at its free extremity and on the other hand has a closed recess surrounding the button and narrowing up to the region of the beak;

only the second arm of the blowing element is connected electrically and mechanically to the fixed arm for supporting the button;

a third arm fast to the extremity of the second arm of the blowing element and having an opening rises perpendicularly to the other two arms, in such a manner that on the one hand the tongue enters into this opening without touching it and, on the other hand, its end is substantially above the plane of the first arm of the element in order to enter into the extinction chamber of which it forms the first wing.

BRIEF DESCRIPTION OF THE DRAWINGS

Other features of the invention will appear from the following description of the drawings, wherein.

DESCRIPTION OF THE PREFERRED EMBODIMENT

Figure 3:
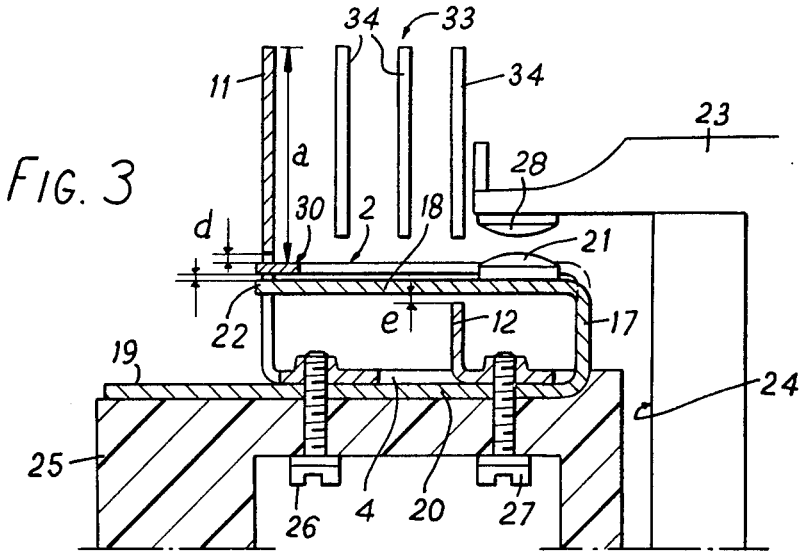
FIG. 3 is a view analogous to that of FIG. 2, with the contact support, the casing and the movable contact bridge.

Referring to FIG. 3, there will be seen the insulating body 25 of the breaker apparatus comprising a movable contact bridge 23 with one of the contact buttons 28, actuated by the contact carrier 24, the fixed contact button 21 which is fixed on a contact support taking the form of a 'U' of which the free arm 18 lies parallel to the fixed arm 20, to which it is coupled by a stem 17. The extremity 19 of the arm 20 serves as a terminal for coupling to the exterior. In the example shown, the fixed contact button 21 is placed nearer to the stem 17 than to the extremity 22 of the arm which carries it.

Figure 1:
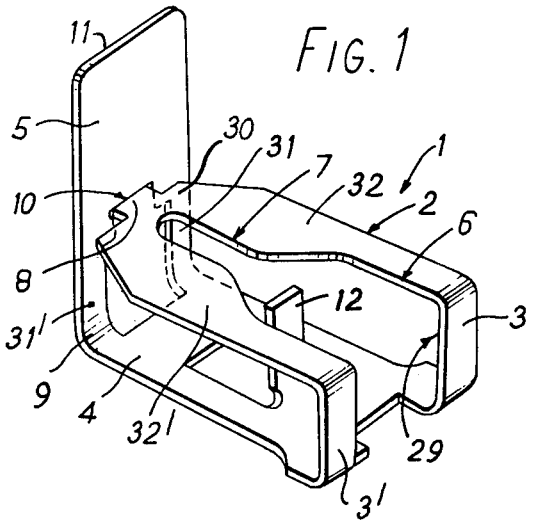
FIG. 1 is a view in perspective of the element in accordance with the invention.
Figure 2:
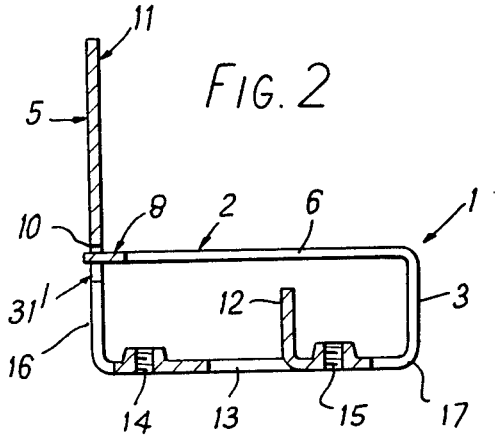
FIG. 2 is a view in section on the plane of symmetry XX', without the button support.
Figure 4:
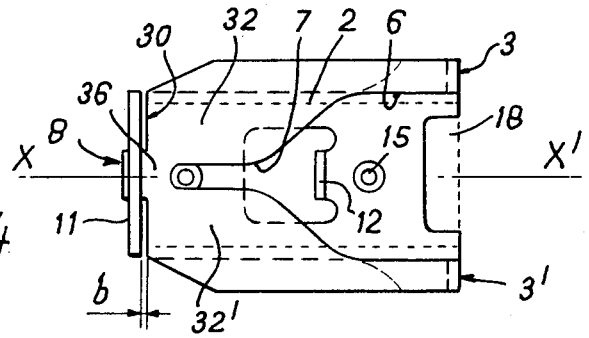
FIG. 4 is a view from above of the invention.

This contact support is coupled mechanically to a blowing element 1, likewise visible in FIGS. 1, 2 and 4, which comprises a first arm 2, the plane of which is disposed substantially in the plane of the fixed contact button 21, (see FIG. 3), while the second arm 4, having the threaded holes 14, 15, presses the arm 20 of the support against the body of the apparatus with the assistance of screws 26, 27, in order to bring about at this level electrical coupling and mechanical fixing.

The first arm 2 is provided with a recess 6 which is sufficiently large to surround the fixed contact button 21 and which is extended on the one hand, to the region of the free extremity 30 and narrows substantially in the region 7 and, on the other hand, towards the stem 17 of the branches whilst forming an opening 29; this same extremity 30 has a tongue 8, the function of which will be examined later.

The traverses 3, 3', coupling the two arms 2, 4, and surrounding the opening 29, are extended by the portions 32, 32' respectively, which surround the recess at the level of the button. This extension 29 of the recess 6 permits notably the passage of the contact support, while permitting passage of the current in the traverses 3, 3'. The flanges 6, 7 of the recess, or the surface of the portions 32, 32', will serve to receive the base of the arcs and it follows as a result that the arm 2 is not in electrical contact with the parallel arm 18 of the support for the fixed button.

The extremity 9 of the second arm 4 of the blowing element comprises an extension 5 which rises perpendicularly to the two arms 2, 4 and substantially at the position of the extremity of the first arm. This extension extends beyond the plane of this latter, over a distance a which is relatively large, in such a manner as to serve as an arc deflector, the extremity 11 of which enters the extinction chamber 33, where there are disposed dividing wings 34 for the arm, and forms the first of these wings.

The opening 10 is formed in the extension 5 of the deflector and is placed at a level such that the tongue 8 mentioned above passes through it, without nevertheless entering into contact with it, by reason of a spacing shown at d. This opening is extended towards the second arm by a larger opening 16 which is surrounded by two narrow lateral portions 31, 31', of the extension. The extremity 30 of the first arm 2 lies parallel to the deflector 5 whilst leaving a gap b visible in FIG. 4, in such a manner as not to have any contact with the deflector.

It will be seen moreover that the extremity 22 of the free arm of the fixed contact support extends under the extremity 30 which has just been mentioned whilst leaving a gap 1. The second arm 4 of the blowing element comprises a lug 12 which has been formed in the example described by bending a portion of this arm and which is directed towards the first arm. This lug extends by such a distance that its extremity is in the neighbourhood of the internal face of the first arm of the contact support whilst leaving a gap indicated by e (see FIG. 3).

Finally, it will be seen from examination of the different figures that the blowing element has been manufactured by cutting out, bending and pressing of a single ferro-magnetic sheet in such a manner that magnetic and electric continuity, as well as a great simplification of manufacture, are simultaneously assured.

Figure 5:
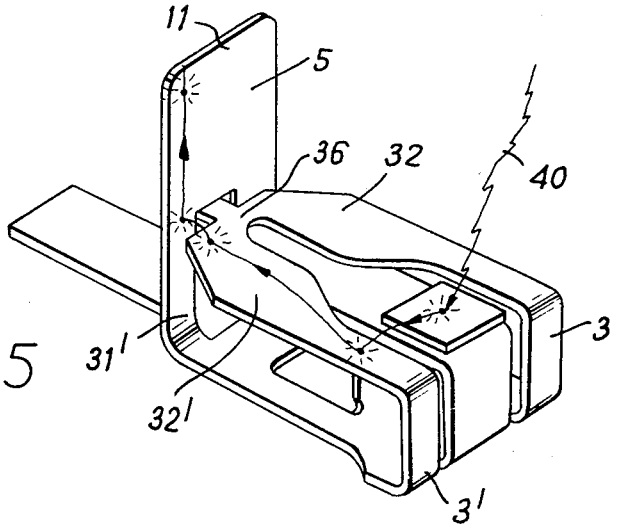
FIG. 5 shows the course of the base of the arc appearing on the fixed contact in the course of the operation of blowing.

The function of this blowing element serving likewise as arc deflector and deformation limiter, will be explained with reference to FIG. 5.

The arc 40 passing between the fixed and movable contacts respectively 21 and 28, is pushed laterally by the electrodynamic effect, in such a manner that its base passes from the fixed contact 21 to the portion 32 or 32' of the first arm.

The arc current then continues to circulate between the movable contact 28, the portion 32 or 32' and the traverse 3 or 3' which is coupled electrically to the contact support.

There is thus assisted the displacement of the base of the arc towards the extremity 30 of the first arm It will be noted that this displacement is slowed down by the existence of a parasitic current circulating through the traverse 3, the portion 32 and the region 36 common to the two portions 32, 32', when the foot of the arc moves onto the portion 32'. This parasitic current is nevertheless very small by reason on the one hand of the length of the path which it must follow and, on the other hand, of the resistance of the region 36. Nevertheless, there has been retained at this region 36 a sufficient section to ensure an accurate mechanical coupling between the portions 32, 32' which prevents the lateral deformation which they could undergo when the temperatures of the system become high.

When the base of the arc reaches the extremity of the first arm, it jumps onto the vertical extension 5 of the deflector. At this moment, the arc current is transmitted by one of the portions 31 or 31' and the arc is moved towards the extremity 11 in order to engage, and then to divide itself on the wings 34 before its final extinction.

The effects which have just been described are all the more efficient when, on the one hand, no contact is established between the first arm of the blowing element and the neighbouring arm of the contact support and when on the other hand, the gaps c, d, b are present. Furthermore, a separation of the traverses 3 and 3' towards the right in this figure improves the effect of joining of the current and this improvement is made possible by the fact that these traverses placed at each side of the fixed contact support can extend up to the region of the movable contact carrier 24.

Finally, the use of a ferrous metal to construct the blowing element is favourable to the obtaining of the phenomena described.

As the repeated arcing phenomena produce a large and non-homogeneous rise of the temperature of the different elements of the arc chamber, it is necessary to limit their deformation.

The deformation of the extremity of the first arms of the blowing element and of the support, upwardly in FIG. 3, is prevented by the presence of the tongue 8 in the opening 10. When the said tongue comes into contact with the wall bounding the opening 10, the contact resistance at this level is nevertheless so high that the parasitic current which is established locally remains negligible, as is the case with that which establishes itself if the extremity 22 of the fixed contact support enters into contact with the tongue 8 or the region 30. Furthermore, the forcing over of the contact support towards the arm 20 is limited by the presence of the lug 12.

We claim:

1. In a blowing element for use with an arc contact assembly having a movable contact, a support in the shape of a 'U' with two parallel arms and a common stem, a fixed contact button disposed on an external free arm thereof in the neighbourhood of said stem, said blowing element having the shape of a 'U' analogous to that of the support to which it is connected electrically and mechanically, said blowing element including two lateral portions surrounding the fixed contact button, these members being disposed in an arc extinction chamber provided with wings, the improvement that a first arm of the blowing element of which a surface is disposed substantially at the level of the plane of the fixed contact without touching the neighbouring arm of the support, has a tongue at its free extremity and a recess surrounding said fixed contact and narrowing up to the region of the tongue, a second arm of the blowing element being coupled electrically and mechanically to that arm of the support not carrying said fixed contact, the blowing element having a third arm, fast to the extremity of the second arm, including an opening and rising perpendicularly to the first and second arms such that its extremity is substantially above the plane of the first arm in order to enter into the arc extinction chamber, of which it constitutes a first wing, and such that said tongue enters into said opening.

2. A blowing element, according to claim 1, characterised in that said recess extends in a region bounded by two narrow lateral portions of the stem of the two arms of the element, in which region there is disposed the stem of the support of the fixed contact.

3. A blowing element, according to claim 1, characterised in that said opening extends in a region surrounded by two narrow lateral portions up to the second arm of the element.

4. A blowing element, according to claim 1, charactertized in that the second arm of the element is placed on the second arm of the support for the fixed contact and comprises threaded openings to receive fixing means, and a lug which extends up to the region of the surface of the first arm of the support directed towards the second arm.

5. A blowing element, according to claim 1, formed by bending from a magnetic sheet cut in a single piece.

* * * * *